United States Patent [19]

Katsuragi et al.

[11] Patent Number: 4,687,357

[45] Date of Patent: Aug. 18, 1987

[54] INK RIBBON CASSETTE FOR USE IN PRINTER

[75] Inventors: Koji Katsuragi; Hirofumi Ozaki; Yoshihiro Kawahara; Hideki Matsumoto; Tetsuro Tomoe; Kazuhiro Kobayashi, all of Osaka, Japan

[73] Assignee: Mita Industrial Co., Ltd., Osaka, Japan

[21] Appl. No.: 786,548

[22] Filed: Oct. 11, 1985

[30] Foreign Application Priority Data

Nov. 26, 1984 [JP] Japan ..... 59-249145

[51] Int. Cl.[4] ..... B41J 32/00

[52] U.S. Cl. ..... 400/208; 400/214; 400/229

[58] Field of Search ..... 400/229, 214, 207, 208, 400/208.1, 217, 223, 222, 231, 233, 235, 206.3, 120

[56] References Cited

U.S. PATENT DOCUMENTS 4,420,268 12/1983 Tsukamura et al. ..... 400/233
4,468,139 8/1984 Hattori ..... 400/120

FOREIGN PATENT DOCUMENTS 205185 12/1982 Japan ..... 400/229
158282 9/1984 Japan ..... 400/233
11385 1/1985 Japan ..... 400/229

OTHER PUBLICATIONS

IBM Technical Disclosure Bulletin, vol. 23, No. 4, Sep. 1980, pp. 1517–1520, "Ribbon Feed for Bidirectional Printer" by Dials et al.

*Primary Examiner*—Charles A. Pearson
*Attorney, Agent, or Firm*—Wenderoth, Lind & Ponack

[57] ABSTRACT

An ink ribbon cassette is constructed such that it is unnecessary to wind off an ink ribbon at the start of every line printing process. The cassette includes two pairs of reels, each pair including an ink ribbon-winding off reel and an ink ribbon-winding up reel. The pairs of rails are rotatably mounted one above the other on a cassette casing which is detachably mounted on a carriage of a printer. The casing is provided with a driving shaft which is rotated in normal and reverse directions in response to reciprocal movement of the carriage. The driving shaft being provided with two one-way clutches transmitting the rotation of the shaft in opposite directions. Conveying members separately convey the ink ribbons for the respective pairs of reels and are driven by respective to the one-way clutches.

4 Claims, 7 Drawing Figures

INK RIBBON CASSETTE FOR USE IN PRINTER

BACKGROUND OF THE INVENTION

1. Field of the Invention

The present invention relates to an ink ribbon cassette used in a printer of the thermal transfer type, wire dot type and the like, and in particular to an ink ribbon cassette for use in a printer which is constructed so that lateral forward movement and return movement of a carriage are changed-over every time a line to be printed is changed, and printing is carried out while an ink ribbon is transferred synchronously with the carriage in a direction opposite to that of movement of the carriage during both the forward movement and the return movement of the carriage.

2. Description of the Prior Art

With the above described type of printer, since an ink ribbon is transferred synchronously with a carriage in a direction opposite to that of the carriage, thereby resulting in increased speed of printing.

However, in order to carry out printing during a given return movement of the carriage, the operation during which an ink ribbon is wound up by a length corresponding to the return printing prior to such given return printing, the return printing being carried out with winding off the wound-up ink ribbon and after winding up the ink ribbon having the return printing thereon the forward printing is carried out, has been repeated. But, such method has the disadvantage that the printing speed is lowered by the time required for winding up the ink ribbon every time the printing is started, whereby the improved printing speed due to return printing is not entirely utilized.

A further disadvantage is that the control of the winding-up of the ink ribbon carried out every time the printing is started is complicated.

SUMMARY OF THE INVENTION

The object of the present invention is to provide an ink ribbon cassette for use in a printer whereby it is possible to eliminate the above described disadvantages.

This object is achieved according to the present invention by providing the ink ribbon cassette with two sets of pairs of reels each including an ink ribbon-winding off reel and an ink ribbon-winding up reel rotatably mounted vertically in a cassette case which is detachably mounted on the carriage of the printer. A transmission shaft is rotated in normal and reverse directions by the reciprocal motion of the carriage. Two one-way clutches mounted on the transmission shaft transmit the rotational power in opposite directions. A conveying member conveys an ink ribbon for each pair of reels separately and is driven through the one-way clutches.

With the above described construction, since ink ribbons of the upper pair of reels and the lower pair of reels are separately transferred synchronously with the forward movement and the return movement of the carriage, the winding-up operation of the ink ribbon prior to the start of printing, which has been conventionally requires, is not required. Thereby, the printing can be speeded up by the time previously required for such winding-up operation. In other words, continuous reciprocal printing can be achieved.

Besides, since it is not necessary to wind up the ink ribbon, the control of the transference of the ink ribbon becomes remarkably simple. Moreover, since two ink ribbons are arranged vertically with respect to each other, the number of times the ink ribbon has to be changed can be reduced by half without increasing the space in which the cassette is arranged. Accordingly, an ink ribbon cassette overcoming conventional disadvantages is provided by a simple constructional improvement as a whole.

BRIEF DESCRIPTION OF THE DRAWINGS

Embodiments of the present invention are shown in the accompanying drawings, in which.

DESCRIPTION OF THE PREFERRED EMBODIMENTS

Figure 1:
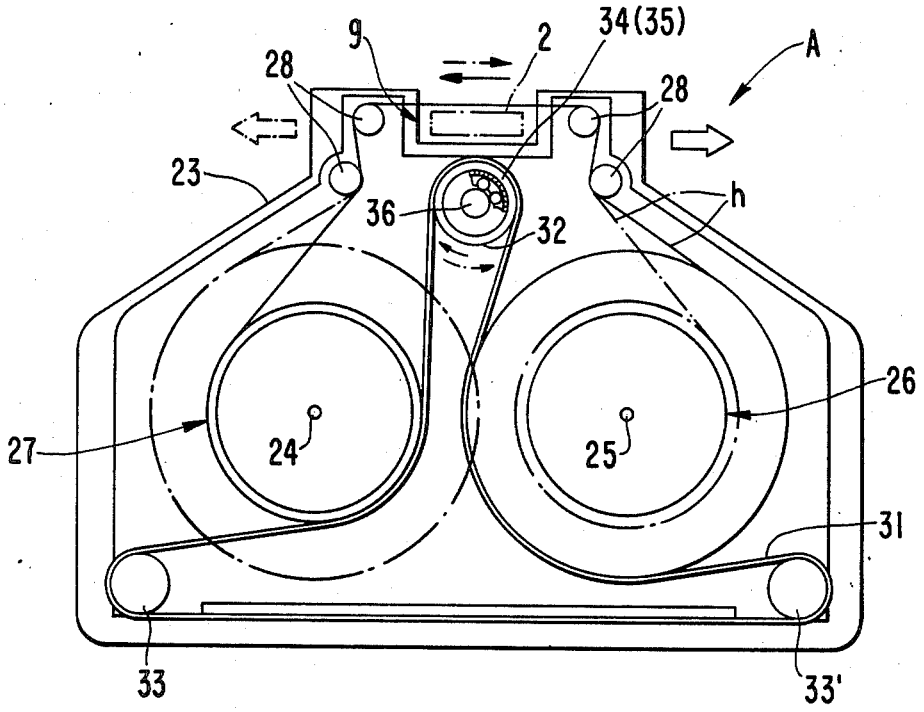
FIG. 1 is a plan showing an ink ribbon cassette wherein an ink ribbon of an upper pair of reels is shown by full lines while an ink ribbon of a lower pair of reels is shown by imaginary lines.
Figure 2:
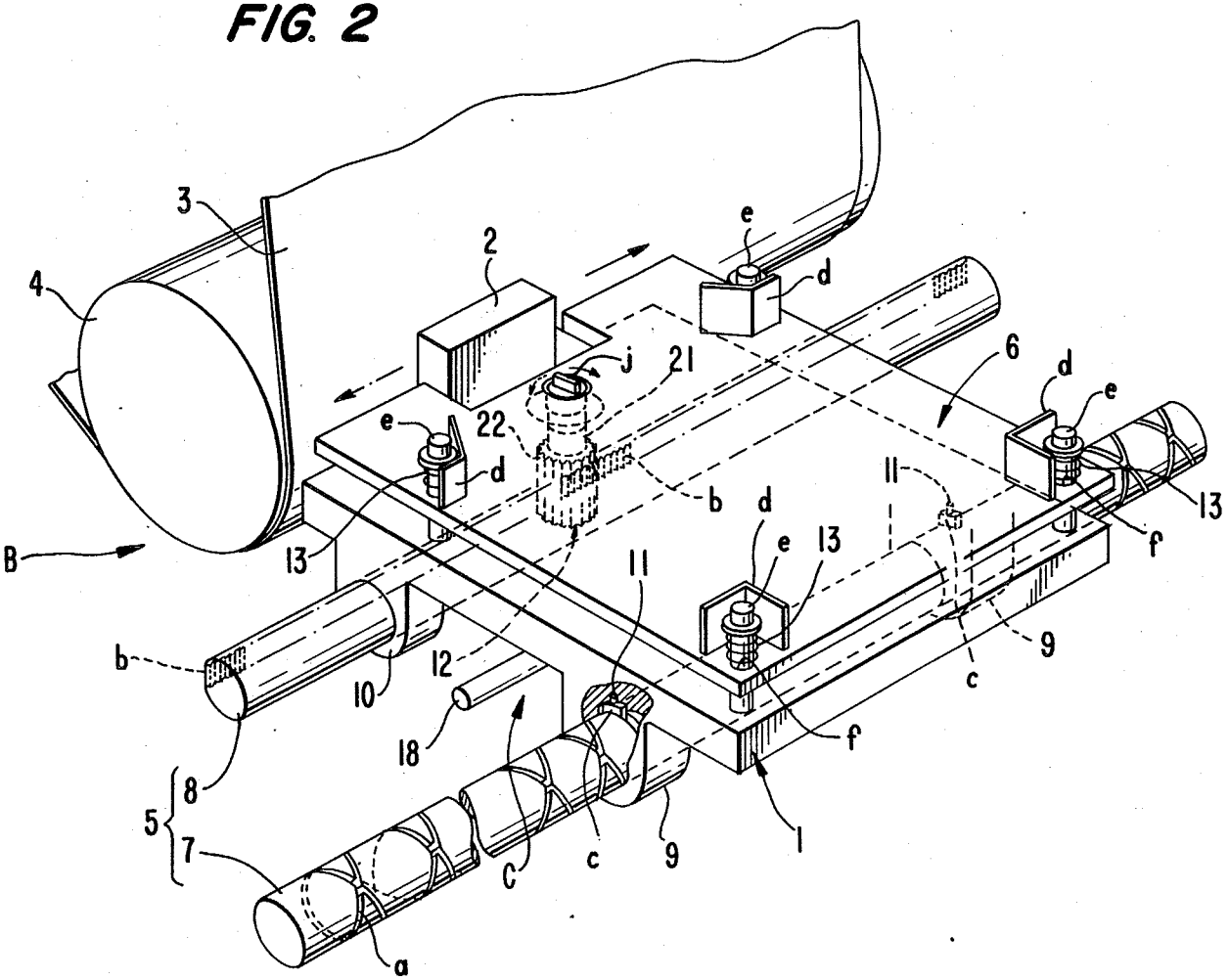
FIG. 2 is a perspective view showing the principal parts of a thermal transfer type printer.
Figure 3:
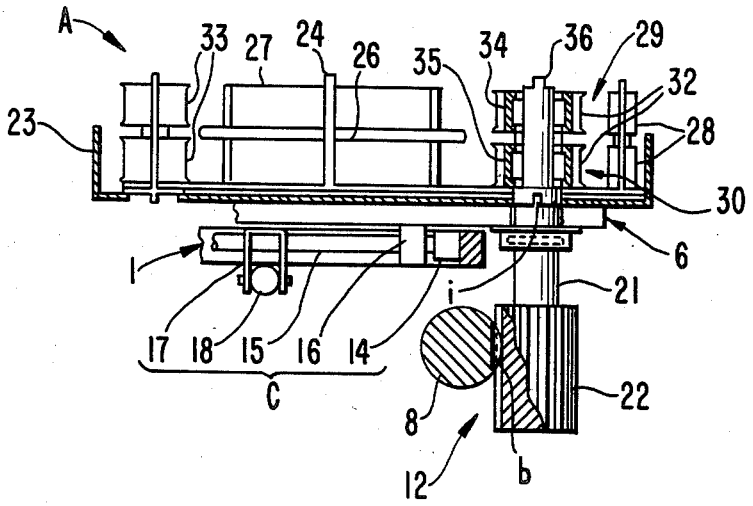
FIG. 3 is a sectional view showing an ink ribbon cassette.

Referring now to FIG. 1 showing one example of an ink ribbon cassette (A), FIG. 2 showing the principal parts of a thermal transfer type printer (B) and FIG. 3 showing the manner of positioning the ink ribbon cassette (A) on a carriage (1), the thermal transfer type printer (B) includes the carriage (1) provided with a thermal head (2) for carrying out a printing operation upon application of printing signals thereto, a platen (4) for winding up an appointed length of a printing paper (3), a reciprocating conveying mechanism (5) for laterally reciprocally conveying carriage (1) axially along the platen (4) and a cassette-charging means (6) to be mounted on carriage (1) and the position of which with respect thereto can be freely adjusted vertically.

The carriage reciprocating conveying mechanism (5) is constructed in the following manner.

A driving rotary shaft (7), provided with an endless spiral groove (a) including a continuous right-hand spiral and a continuous left-hand spiral, and a fixed shaft (8), on which a rack (b) is formed, are positioned so that axes thereof are parallel to an axis of a rotary shaft of platen (4). Bosses (9), (10) of carriage (1) are pivotally supported on shafts (7), (8), respectively. A slide member (c) having a width slightly smaller than that of spiral groove (a) and a length longer than the width of spiral groove (a) is mounted on one boss (9) so as to be rotatable around a shaft (11) extending at a right angle to driving rotary shaft (7). Slide member (c) extends into spiral groove (a), such that slide member (c) is reciprocally moved in the direction of the axis of driving rotary shaft (7) upon rotation of driving rotary shaft (7), thereby also reciprocally moving carriage (1).

Cassette-charging means (6) is provided with cassette-positioning means (d), an ink ribbon-driving mechanism (12) and holes (f) through which extend guide pins (e) positioned on carriage (1). Carriage (1) is provided with a cam mechanism (C) for lifting up cassette-charging means (6) against the force of springs (13) mounted on guide pins (e) and urging means 6 downwardly.

Figure 4A:
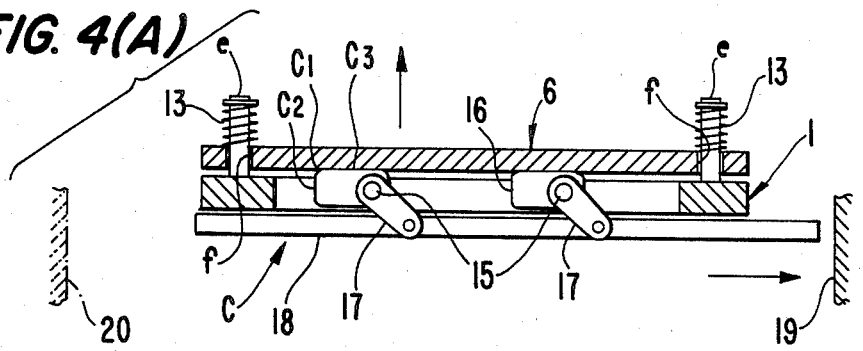
FIGS. 4(A) and 4(B) are detailed operational diagrams showing a cam mechanism.
Figure 4B:
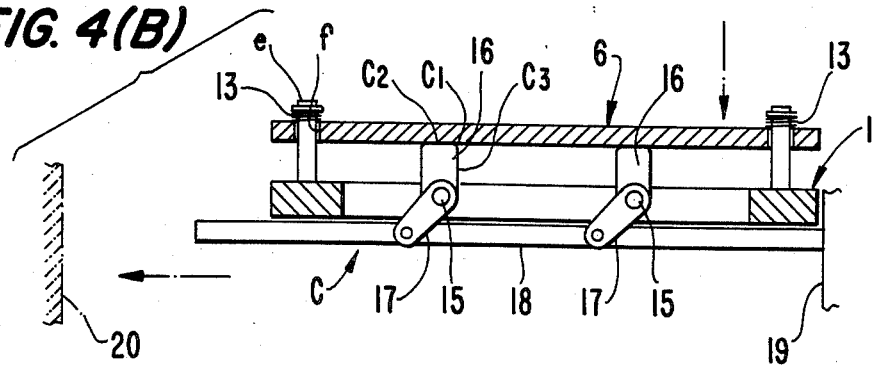

As shown in FIGS. 3, 4, cam mechanism (C) includes horizontal shafts (15) extending at right angles to the moving direction of carriage (1) and rotatably installed in a hollow portion formed in a central part of carriage (1) by a bracket (14). Cam bodies (16) and arms (17) are fixedly mounted on horizontal shafts (15). Cam bodies (16) are provided with respective cam surface portions ($C_1$) for raising cassette-charging means (6) against the force of springs 13 and attitude-holding surface portions ($C_2$), ($C_3$) for stably holding a raised attitude or position of means 6 (FIG. 4(B)) and a lowered attitude or position thereof (FIG. 4(A)). A rod (18) is pivotally connected to free ends of arms (17) and stoppers (19), (20) are positioned to be engaged with opposite end portions of rod (18) in the vicinity of the ends of reciprocal movement of carriage (1).

As shown in FIGS. 4(A), 4(B), upon arrival of carriage (1) at the end of the forward movement thereof (the rightward movement as seen therein), rod (18) is moved relative to carriage 1 by stopper (19) such that arms (17) are pivoted, thereby pivoting shafts (15) and rotating cam bodies (16) to the positions shown in FIG. 4(B), thereby raising the cassette-charging means (6) against the force of springs (13). Upon arrival of carriage (1) at the end of the return movement thereof, rod (18) is moved relative to carriage (1) by stopper (20), whereby the arms (17) are pivoted in the reverse direction, and the cam bodies (16) are rotated in the reverse direction, thereby lowering cassette-charging means (6) due to the force of springs (13).

Ink ribbon-driving mechanism (12) comprises a rotary shaft (21) mounted on cassette-charging means (6) for movement relative thereto only rotatably and a pinion (22) integral with shaft 21 and engaged with rack (b) in all relative vertical positions of cassette-charging means (6). Clockwise rotation of rotary shaft (21), as viewed in FIG. 2, is accompanied by forward movement of carriage (1), while counterclockwise rotation of rotary shaft (21) is accompanied by return movement of carriage (1).

Next, the construction of the ink ribbon cassette (A) will be described. As shown in FIGS. 1 to 3, the ink ribbon cassette (A) comprises two reel-pivoting shafts (24), (25) extending upwardly from a cassette case (23) detachably mounted on the cassette-charging means (6) of carriage (1) and provided with a recessed portion (g) for the extension therethrough of the thermal head (2). An upper pair and a lower pair of reels, each pair including a winding-off reel (26) and a winding-up reel (27) for a respective ink ribbon (h), are rotatably mounted on reel pivoting shafts (24), (25) in a superposed manner. First and second, i.e. upper and lower, conveying means (29), (30) separately convey the respective ink ribbons (h) between the respective upper and lower pairs of reels and around rollers (28) in the vicinity of portion (g).

First and second conveying means (29), (30) each comprises an endless belt (31) brought into contact with the outer circumferential surface of the respective ink ribbon (h) wound around the respective pair of reels, a driving roller (32) and idle rollers (33), (33') for separately winding the belt (31). A single driving shaft (36) rotatably supports driving rollers (32) via respective one-way clutches (34), (35). Connecting portions (i), (j) are provided between shaft (36) and shaft (21) so that driving shaft (36) may be interlockingly connected with rotary shaft (21) of ink ribbon-driving mechanism (12).

The direction of transmission of the one-way clutch (34) of the first conveying means (29) for the ink ribbon (h) of the upper pair of reels is set so that the rotation (i.e. clockwise rotation as seen in plan) of driving shaft (36) will be transmitted to the upper driving roller (32) during forward movement of carriage (1), while the direction of transmission of the one-way clutch (35) of the second conveying means (30) is set so that counterclockwise rotation as seen in plan of the driving shaft (36) will be transmitted to the lower driving roller (32). Also, the peripheral speeds of the two driving rollers (32) are synchronized with the reciprocal moving speeds of carriage (1).

In addition, the winding off reel (26) of the lower pair of reels is arranged below the left respective winding up reel (27) while, for the upper pair of reels, the ink ribbon-winding off reel (26) is arranged below the right respective winding up reel (27).

With the above described construction, only the ink ribbon (h) of the upper pair of reels is transferred in a direction opposite to that of the movement of the carriage (1) while being synchronized with the moving speed of the carriage (1) by the action of the first conveying means (29) accompanied by the forward movement of carriage (1), and upon application of a printing signal to the thermal head (2) during that period ink of the upper ink ribbon (h) is thermally transferred onto the printing paper (3).

Then, upon arrival of the carriage (1) at the end of the forward movement thereof, cassette-charging means (6) is lifted by the cam mechanism (C), and the lower ink ribbon (h) is positioned to face the thermal head (2). The platen (4) is rotated by an extend corresponding to a line-change. The carriage (1) starts its returning movement, and only the ink ribbon (h) for the lower pair of reels is conveyed in a direction opposite to that of the movement of the carriage (1) in synchronization with the moving speed of the carriage (1) by the action of the second conveying means (3) accompanied by the returning movement of carriage (1). Upon application of a printing signal to the thermal head (2), ink of the lower ink ribbon (h) is thermally transferred onto the printing paper (3).

Then, upon arrival of the carriage (1) at the end of the returning movement thereof, the cassette-charging means (6) is lowered to the position where the upper ink ribbon (h) faces the thermal head (2). The platen (4) is rotated by an extent corresponding to a line-change, and the carriage (1) starts its forward movement again. Thereafter, the above sequence of operations is repeated.

The directions of movements for the above described forward movement of the carriage (1) are indicated by full line arrows in the drawings, while those for the return movement of the carriage (1) are indicated by imaginary line arrows.

Although the position of cassette-charging means (6) is changed upwardly and downwardly for every line change in the above embodiment, the position of the thermal head (2) may be moved downwardly at the end of the forward movement of the carriage (1) and upwardly at the end of the return movement of the carriage (1). In such case, the platen (4) is rotated by two lines upon the completion of a printing operation of reciprocal movement of the carriage (1).

Also, two sets of pairs of rollers with an ink ribbon (h) for each pair of reels may be provided as the first and second conveying means (29), (30), and one roller of each pair of rollers may be driven at a constant speed by means of the driving shaft (36) through the one-way clutches (34), (35). That is to say, the ink ribbons (h)

may be adapted to be conveyed separately at the constant speed, each of reels (26, (27) being nonrotatable relative to the shafts (24), (25), and shafts (24), (25) being selectively driven through a friction plate to adopt the tape-driving form of "cassette tape recorder", that is to sat the constituent members for conveying the ink ribbon. Such endless belts and the like are termed generically conveying members for separately conveying ink ribbons in the present invention.

Figure 5A:
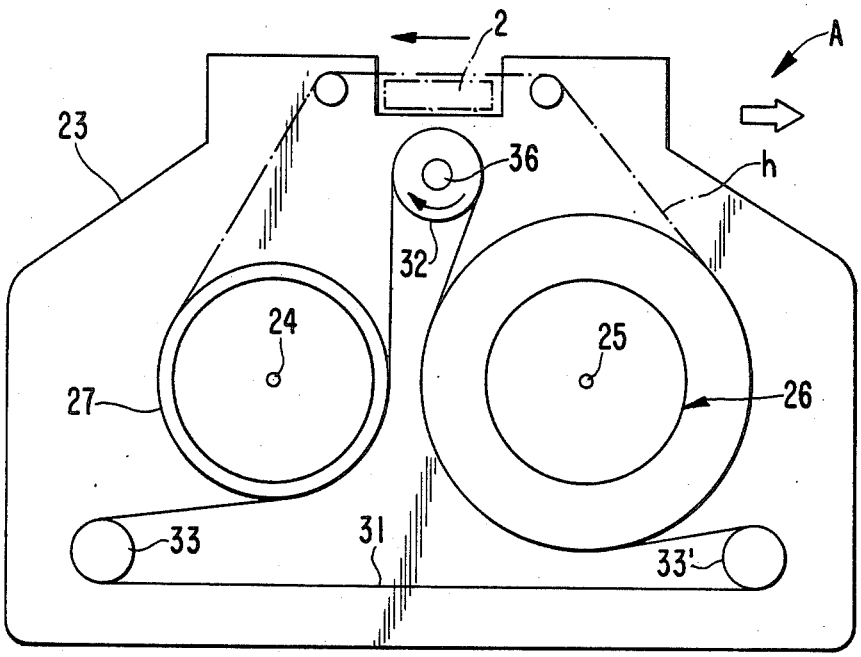
FIGS. 5(A) and 5(B) are diagrams showing the winding of another embodiment of an ink ribbon cassette.
Figure 5B:
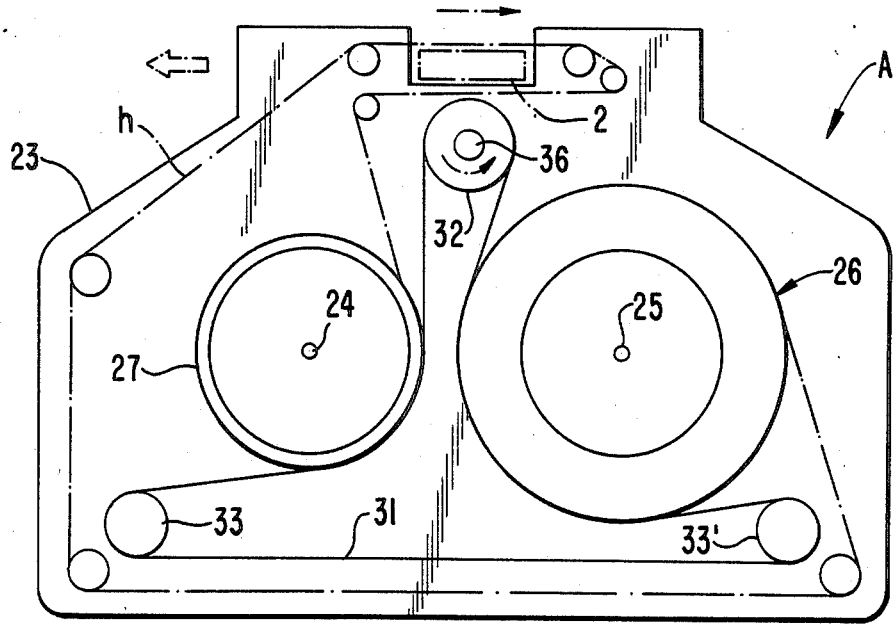

Also, although a cassette construction in which an ink ribbon-winding off reel (26) and an ink ribbon-winding up reel (27) are arranged vertically is adopted in the above described embodiment, a construction in which both ink ribbon-winding off reels (26) and both ink ribbon-winding up reels (27) are vertically arranged may be adopted. An example of ink ribbons (h) with such an arrangement of reels (26), (27) is shown in FIG. 5(A) and 5(B). Since the same constituent parts as shown in FIGS. 1 to 4(B) are employed in FIGS. 5(A) and 5(B), further description thereof is omitted.

What is claimed is:

1. An ink ribbon cassette for use in a printer of the type including a carriage reciprocal in opposite first and second longitudinal directions and carrying a printing head printing during movement in both said directions, said cassette comprising;

a casing to be removably mounted on the carriage of the printer;

first and second pairs of ink ribbon reels, each said pair comprising an ink ribbon-winding off reel and an ink ribbon-winding up reel having extending therebetween a respective ink ribbon, said pairs of reels being mounted one above the other on said casing with rotation axes of said reels of said first pair coaxially aligned with rotation axes of said reels of said second pair;

a single driving shaft rotatably mounted on said casing and including means for enabling rotation thereof in first and second opposite rotary directions in response to movement of the carriage in respective opposite longitudinal directions;

first one-way clutch means, mounted on said single drive shaft, for transmitting rotation of said drive shaft upon rotation thereof in said first rotary direction and for preventing transmission of rotation of said drive shaft upon rotation thereof in said second rotary direction;

second one-way clutch means, mounted on said single drive shaft, for transmitting rotation of said drive shaft upon rotation thereof in said second rotary direction and for preventing transmission of rotation of said drive shaft upon rotation thereof in said first rotary direction;

said first and second clutch means being coaxially mounted one above the other on said single drive shaft in alignment with respective said first and second pairs of reels;

first conveying means, connected between said first one-way clutch means and said first pair of reels, for conveying said ink ribbon of said first pair of reels between said reels thereof during rotation of said single drive shaft in said first rotary direction, said first conveying means being inoperable during rotation of said single drive shaft in said second rotary direction to prevent conveying of said ink ribbon of said first pair of reels; and second conveying means, connected between said second one-way clutch means and said second pair of reels, for conveying said ink ribbon of said second pair of reels between said reels thereof during rotation of said single drive shaft in said second rotary direction, said second conveying means being inoperable during rotation of said single drive shaft in said first rotary direction to prevent conveying of said ink ribbon of said second pair of reels;

2. A cassette as claimed in claim 1, wherein said winding off reel of said first pair of reels and said winding up reel of said second pair of reels are coaxially alingned, and said winding up reel of said first pair of reels and said winding off reel of said second pair of reels are coaxially aligned.

3. A cassette as claimed in claim 1, wherein said winding off reels of said first and second pairs of reels are coaxially aligned, and said winding up reels of said first and second pairs of reels are coaxially aligned.

4. A cassette as claimed in claim 1, wherein said first and second conveying means comprise respective endless belts extending around portions of peripheries of respective said one-way clutch means and said reels.

* * * * *